US005491883A

United States Patent [19]

Marlinga

[11] Patent Number: 5,491,883

[45] Date of Patent: Feb. 20, 1996

[54] METHOD OF MANUFACTURING A NON-LINEAR COMPOSITE TUBE

[75] Inventor: Terrance C. Marlinga, Kawkawlin, Mich.

[73] Assignee: AP Parts Manufacturing Co., Toledo, Ohio

[21] Appl. No.: 358,263

[22] Filed: Dec. 19, 1994

[51] Int. Cl.[6] ..... B23P 17/00

[52] U.S. Cl. ..... 29/421.1; 29/890.08; 72/369; 228/155

[58] Field of Search ..... 138/155, DIG. 8; 285/173, 177, 286, 382; 29/421.1, 890.08, 897.2; 72/369; 228/155, 158, 178

[56] References Cited

U.S. PATENT DOCUMENTS

| | | | |
|---|---|---|---|
| 3,276,541 | 10/1966 | Deremer | 29/890.08 |
| 3,404,445 | 10/1968 | Crouse | 29/890.08 |
| 3,889,772 | 6/1975 | Kelley | 29/890.08 |
| 4,732,025 | 3/1988 | Marlinga et al. . | |
| 4,928,509 | 5/1990 | Nakamura | 29/421.1 |
| 4,959,984 | 10/1990 | Trudell et al. . | |
| 5,333,775 | 8/1994 | Bruggemann et al. | 228/155 |

FOREIGN PATENT DOCUMENTS

| | | | |
|---|---|---|---|
| 1206072 | 9/1970 | United Kingdom | 29/421.1 |

OTHER PUBLICATIONS

Dittrich et al., United States Statutory Invention Registration, Reg. No. H82, Jul. 1, 1986.

*Primary Examiner*—David P. Bryant
*Attorney, Agent, or Firm*—Anthony J. Casella; Gerald E. Hespos

[57] ABSTRACT

A composite tube and method of manufacture are provided. The composite tube is formed from a plurality of tube segments which are different from one another. The tube segments may differ in cross-sectional dimensions and/or material of manufacture. The tube segments are welded in end-to-end relationship to define a composite tube. The composite tube is then bent into a selected non-linear shape. Preferably, the welds are disposed at locations on tangents between adjacent bends. Bending forces and bending speed are altered from one bend to the next in view of anticipated strength and metallurgical characteristics of the particular tube segment in which the bend is being carried out.

12 Claims, 2 Drawing Sheets

METHOD OF MANUFACTURING A NON-LINEAR COMPOSITE TUBE

BACKGROUND OF THE INVENTION

1. Field of the Invention.

The subject invention relates to elongate non-linear tubes having at least two longitudinal sections that are different from one another in size, shape or composition. The tubes may be used for structural support or for incorporation into a vehicular exhaust system.

2. Description of the Prior Art.

Prior art tubes have many automotive and industrial uses. For example, prior art tubes are used to transport exhaust gases produced by an internal combustion engine. Prior art tubes also are used for structural support, such as in frames of vehicles. Most tubes have a circular cross-sectional shape. However, tubes can assume any cross-sectional shape, and many prior art tubes used for structural support are rectangular in cross-section.

Tubes often must assume a non-linear alignment. In some environments, the required non-linear alignment can be achieved with short linear lengths of tubing connected by fittings. In other environments, such as vehicular exhaust systems and structural supports, the tubes must be bent into a very precisely defined non-linear shape. For example, vehicular exhaust pipes typically must follow a very circuitous path from the engine compartment of the vehicle to a location on the vehicle where exhaust gases can be safely emitted. Precisely located and dimensioned bends are required to bypass other components of a vehicle with sufficient clearance to avoid vibration related contact and heat related damage. A small bending error at one end of an exhaust system can yield a very substantial misalignment at the opposed end of the exhaust system. Precision is even more important for tubes used in structural applications. For example, bent tubes often are used for the longitudinally extending side rails of the support frames of vehicles. Engine mounts, suspension system components and body components must be anchored to the support frame at locations that are specified to very small tolerance variations.

Most precision tube bending is carried out with a programmable bender. The typical prior art bender includes a bend die, a clamp die and a pressure die. The bend die includes an arcuate surface about which the tube will be bent. The pressure die is disposed radially outwardly from the bend die and is capable of movement in a radial direction for selectively clamping the tube against the bend die. The clamp die also engages the tube and also is disposed radially outwardly from the bend die. Initially the clamp die is adjacent to the pressure die. However, the clamp die can be rotated about the axis of the bend die to bend the tube about the outer circumference of the bend die. The angular size of the bend is determined by the amount of rotation of the clamp die from its starting position.

The prior art programmable bender also includes a collet that grips one end of the tube to be bent. The collet functions to move the tube axially and rotationally pre-programmed amounts relative to the bend die. Thus, the collet ensures that each sequential bend in a tube is at the proper spacing and the proper rotational orientation relative to the preceding bend.

Each bend causes a stretching of metal on the outer circumferential surface of the bend and a compression of metal on the inner circumferential surface of the bend. To minimize the effects of stretching, many prior art programmable benders also include a pressure die boost which effectively functions to push tubing into the bend and to thereby prevent excessive stretching. Some benders include a collet boost to assist the pressure die boost by pushing the pipe into the bend. Damage during a bending operation also can be prevented by a mandrel disposed inside the tube at the location of the bend.

Very effective prior art benders are shown in U.S. Pat. No. 4,732,025 and U.S. Pat. No. 4,959,984 both of which are assigned to the assignee of the subject invention. The bender shown in U.S. Pat. No. 4,732,025 includes all of the operative components described in the preceding paragraph. Additionally, the bender includes sensors which detect whether the rotational movement of the bend die and the clamp die has the intended effect. In particular, metallurgical characteristics may vary from one tube to the next and from one location to another along each tube. Most tubes will exhibit some springback after the pressure exerted by the clamp die has been released. The amount of springback can vary significantly depending upon metallurgical characteristics of the particular pipe. Thus, even though the bender may perform precisely the same operation for two different pipes, the resulting bent pipes may not have the same bent shapes due to different springback. The bender shown in U.S. Pat. No. 4,732,025 senses the actual position of bent portions of the pipe, and compares the actual sensed position to a pre-specified position. If necessary, the bender shown in U.S. Pat. No. 4,732,025 can perform compensating bending operations to offset differential springback. Different tubes will exhibit different resistance to the bending and clamping forces exerted thereon. For example, some tubes will yield easily in response to bending forces and will generate excessive stretching in the outer wall of the tube. The apparatus shown in U.S. Pat. No. 4,959,984 will sense resistance and alter forces the pressure die boost and/or with the collet boost assist to effectively urge more or less of the tube into the bend. In this manner the apparatus shown in U.S. Pat. No. 4,959,984 is capable of highly precise bending due to the ability of the bender to react to sensed conditions for the actual pipe being bent.

Hydroforming has been used to deform short sections of prior art tubes. This process involves placing the short section of tube in a mold cavity conforming to the desired shape of the tube. The ends of the tube are then plugged, and fluid under pressure is directed into the plugged tube. The fluid causes the shape of the tube to change to conform to the shape of the mold cavity.

In addition to meeting certain dimensional tolerances, bent tube also must meet performance requirements. For example, certain regions of a structural tube may be particularly susceptible to vibration related damage, while other regions of the same tube may be susceptible to corrosion related damage. Some regions of a tube may include a specified material or coating primarily for aesthetic appearance. Other regions may require changes to the cross-sectional dimensions or shape. Specifications are likely to vary significantly along the length of a tube used for a vehicular frame. For example, the required wall thickness, the required cross-sectional shape and the required cross-sectional dimensions can vary significantly in accordance with the nature of the load being carried at a particular location on the tube. In other instances, the required surface coating of a supporting tube can vary significantly from one longitudinal location to the next.

Prior art tubes have been uniform along their length. This generally has required an over design of the tube so that the entire tube is made to meet the greatest load encountered anywhere along the length of the tube. Additionally, the cross-sectional shape, dimensions and surface coating for the entire bent tube typically have been dictated by the requirements at the most critical location. This occasionally requires compromises to be made at other locations along the tube.

In view of the above, it is an object of the subject invention to provide a non-linear tube that more nearly meets the specified design criteria for each location along the tube.

It is another object of the subject invention to provide a method of making a non-linear tube that more accurately meets the specifications for the entire tube.

SUMMARY OF THE INVENTION

The subject invention is directed to an elongate composite tube bent and/or hydroformed into a specified non-linear configuration and/or a specified non-uniform cross-sectional shape. The composite tube includes a plurality of longitudinal segments integrally joined in end-to-end relationship with one another. The joining of adjacent longitudinal segments may be achieved with laser welding.

Each longitudinal segment of the tube is different from each longitudinal segment adjacent thereto. The differences between adjacent longitudinal segments may relate to the type of metal material from which the segment is made, the wall thicknesses of the tube, or the external dimensions of the tube. Characteristics for the respective longitudinal segments of the tube are selected in accordance with the structural and performance specifications for that segment. Preferably, the connections between longitudinal segments are selected to lie on cross-sectionally uniform tangents between adjacent bends of the non-linear tube. However, depending upon the magnitude of the bend, certain joints between longitudinal segments may be disposed within a bend.

The subject invention also is directed to a method for making a non-linear tube that closely conforms to structural and performance specifications at each location along the tube. The method includes a first step of selecting a plurality of linear tube segments having strength and performance characteristics appropriate for selected locations along the length of a specified bent tube. The tube segments are cut to selected lengths and are securely connected in end-to-end relationship with one another. The connection of the tube segments preferably is carried out by laser welding. The joined linear tube segments may then be subjected to a bending operation which may be carried out in a pre-programmed bending apparatus. The apparatus may include at least one bend die, at least one clamp die and at least one pressure die conforming to cross-sectional shapes of the composite tube at selected locations along the length. The pre-programmed bender may then be operated to bend the composite tube into a specified non-linear shape. The boost pressure, clamping pressure and bending speed all may be adjusted to conform to the metallurgical characteristics of the particular segment of the composite tube being bent. Various aspects of the bending operation may be sensed during and after each bend to assess the actual results of the bend and to adjust the bender as needed. The method may also include the step of hydroforming the tube so that the cross-sectional shape of at least one tube segment is changed. The hydroforming may be carried out to create a shape specifically configured for engaging a structural support or a suspension system component of a vehicle frame.

DETAILED DESCRIPTION OF THE PREFERRED EMBODIMENT

Figure 1:
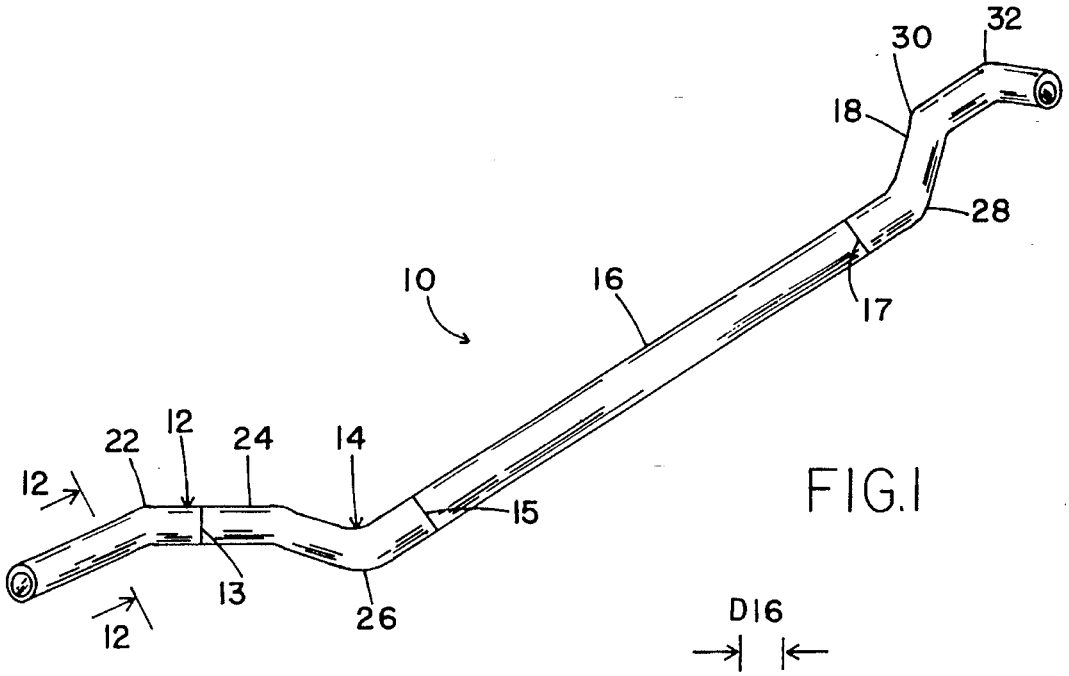
FIG. 1 is a perspective view of the non-linear composite tube of the subject invention.

A non-linear composite tube in accordance with the subject invention is identified generally by the numeral 10 in FIG. 1. The non-linear composite tube 10 is formed from four dissimilar tube segments 12, 14, 16 and 18 respectively which are laser welded in end-to-end relationship at seams 13, 15 and 17 respectively.

Figure 2:
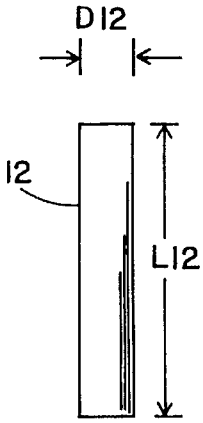
FIG. 2 is a top plan view of a first segment of the composite tube of the subject invention.
Figure 3:
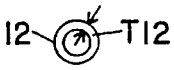
FIG. 3 is an end elevational view of the first tube segment.

The tube segment 12 is initially linear and defines a length $L_{12}$ as shown in FIG. 2. The tube segment 14 is of circular cross-section, and defines a diameter $D_{12}$ and a tube thickness as shown most clearly in FIG. 3.

Figure 4:
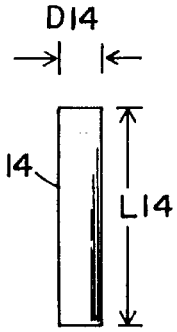
FIG. 4 is a top plan view of a second segment of the composite tube of the subject invention.
Figure 5:
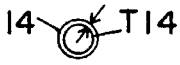
FIG. 5 is an end elevational view of the second tube segment.

The tube segment 14, as shown in FIGS. 4 and 5, also is initially linear and defines a length $L_{14}$. The tube segment 14 has a diameter $D_{14}$ as shown in FIG. 5, which is slightly less than the diameter $D_{12}$ for the tube segment 12 shown in FIG. 3. Additionally, the tube segment 14 has a thickness $T_{14}$ which is slightly less than the thickness $T_{12}$ for the tube segment 12 depicted in FIG. 3.

Figure 6:
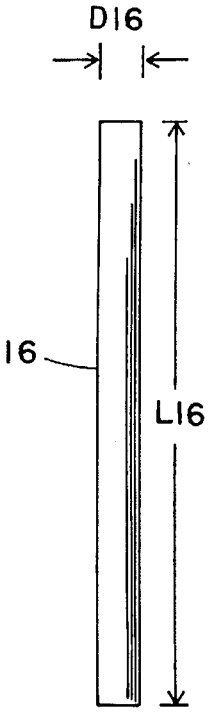
FIG. 6 is a top plan view of a third segment of the composite tube of the subject invention.
Figure 7:
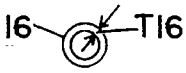
FIG. 7 is an end elevational view of the third segment of tube.

The tube segment 16, as shown most clearly in FIGS. 6 and 7, also is initially linear, but defines a length $L_{16}$ which is significantly greater than the corresponding linear lengths of the tube segments 12 and 14. The diameter $D_{16}$ and thickness $T_{16}$ of the tube segment 16 are approximately equal the corresponding diameter $D_{14}$ and thickness $T_{14}$ of the tube segment 14. However, the tube segment 16 is formed a different type of metallic material.

Figure 8:
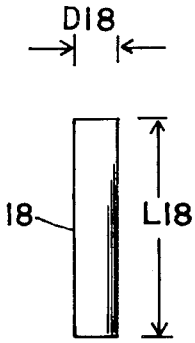
FIG. 8 is a top plan view of a fourth segment of the composite tube of the subject invention.
Figure 9:
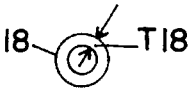
FIG. 9 is an end elevational view of the fourth tube segment.

As shown in FIGS. 8 and 9, the tube segment 18 is initially linear and defines a length $L_{18}$ which is less than the length $L_{16}$ of the tube segment 16 shown in FIG. 6. The tube segment 18 defines a diameter $D_{18}$ which equals the diameter $D_{16}$ on tube segment 16 and a thickness $T_{18}$ which is greater than the corresponding thickness $T_{16}$ on tube segment 16. Additionally, tube segment 18 is provided with a thin anti-corrosion coating thereon.

Figure 10:
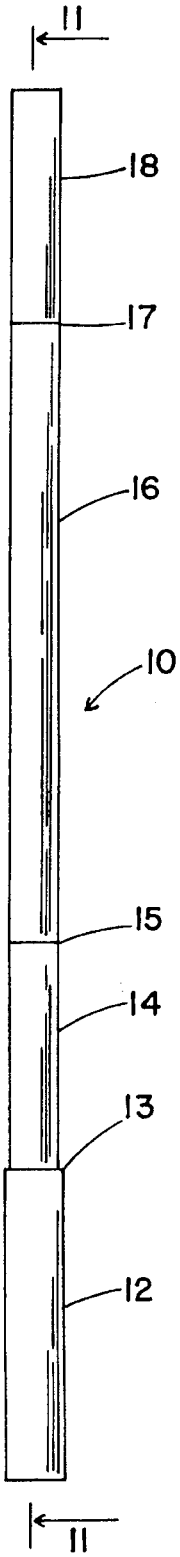
FIG. 10 is a side elevational view of a composite tube of the subject invention prior to bending.
Figure 11:
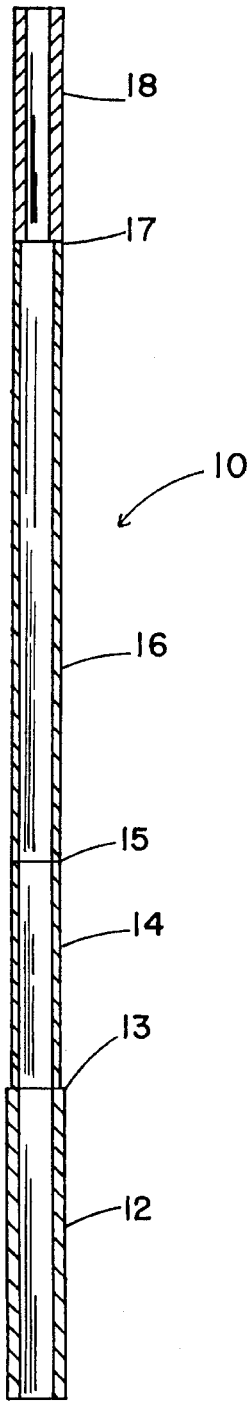
FIG. 11 is a cross-sectional view taken along line 10—10 in FIG. 5.

As shown in FIGS. 10 and 11, the tube segments 12, 14, 16 and 18 are laser welded to one another in end-to-end relationship to define the weld seams 13, 15 and 17 respectively, as noted above. In this orientation, the inner and outer walls include minor discontinuities in proximity to the laser weld seams 13 and 17. However, the respective thicknesses of the tube segments 12, 14 and 16 are selected to ensure sufficient end-to-end contact area for achieving structurally secure laser welds.

The linear composite tube 10 shown in FIGS. 10 and 11 is presented to a programmable bender for precisely placing bends 22, 24, 26, 28, 30 and 32 in the composite tube 10. As illustrated clearly in FIG. 1, the lengths of the respective tube segments 12, 14, 16 and 18 are selected to ensure that the weld seams 13, 15 and 17 will lie within tangents between adjacent respective bends 22, 24, 26 and 28 and 30 and 32 placed in the composite tube 10 by the programmable bender. Thus, the weld seams 13, 15 and 17 will not be subjected to stretching or compression by the bending apparatus.

The different diameter and thickness dimensions for the tube segments 12, 14, 16 and 18 are selected in view of structural performance requirements for the composite tube 10 at various locations along its length. For example, if the composite tube 10 is used as a side rail in a vehicular frame, the tube segments 12, 16 and 18 may have dimensions selected to accommodate bending moments and other forces exerted by suspension system components mounted nearby. The tube segment 18 may be at a location likely to be visually observed or to be subjected to exposure to moisture and de-icing chemicals. Hence, a special coating may be applied to tube segment 18. The dimensions of various tube segments also may be selected in view of the number of holes or features installed into the composite tube 10 to support other frame components and/or other parts of the vehicle.

The different dimensions and materials used for the composite tube 10 will result in vastly different resistances in response to bending forces. As a result, the bending of composite tube 10 from the linear alignment shown in FIGS. 10 and 11 to the non-linear alignment shown in FIG. 1 preferably is carried out with a bender as shown in the above referenced U.S. Pat. No. 4,732,025 and U.S. Pat. No. 4,959,984. In addition to sensing certain characteristics during the bending operation, the bender is programmed to alter bending speed and forces exerted by the pressure die, the pressure die boost and the collet boost assist in view of known dimensional and material differences at the locations at which each sequential bend will take place. Thus, bends placed in the tube segments with larger cross-sections or thicker pipe walls may be carried out at different bends in thinner pipes. Additionally, boost pressure may be increased for bends carried out in certain tube segments. These variations in pressure and bend speed can be pre-programmed to approximate anticipated reactions of the different tube segments 12, 14, 16 and 18 to the bender. However, conditions sensed by the programmable bender, as shown in U.S. Pat. No. 4,732,025 or in U.S. Pat. No. 4,959,984 effectively enable a fine tuning of bending conditions in response to the particular tube segment being bent.

Figure 12:
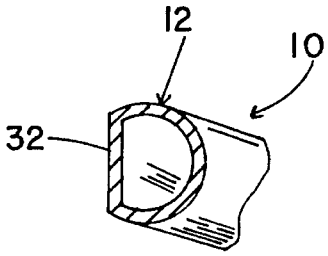
FIG. 12 is a cross-sectional view taken along line 12—12 in FIG. 1.
Figure 13:
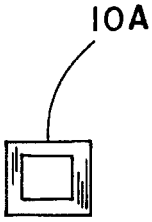
FIG. 13 is an end elevational view similar to FIGS. 3, 5, 7 and 9, but showing an alternate tube shape.

The method may further include the step subjecting the composite tube 10 to hydroforming to deform selected locations along the tube. For example, as shown in FIG. 12 at least one location along tube segment 12 may be hydroformed to define a flat 32 to which another structural element may be mounted. When the composite tube 10 is used as a side rail for a vehicular frame, flat 32 may be used to mount a suspension system component or an engine mount. Other hydroformed shapes may be provided at other locations along the length of composite pipe 10. Advantageously, hydroforming enables conventional circular pipes to be used for side rails, with hydroformed flats at specified locations as needed. Circular cross-section pipes often provide for easier three dimensional bending than the rectangular pipes that are more commonly used for side rails and other structural applications. However, as shown in FIG. 13, a composite tube 10A of rectangular cross-section can be provided with dissimilar tube segments in accordance with the method described above.

While the invention has been described with respect to a preferred embodiment, it is apparent that various changes can be made without departing from the scope of the invention as defined by the appended claims. For example, circular tubes are shown in the accompanying drawings. However, tubes with rectangular or oval cross-sections are within the scope of the invention. Additionally, the attached drawings show most differences relating to cross-sectional dimensions. However, the tube segments may be cross-sectionally identical, but differences between tube segments may relate to the material from which the tube segments are formed and/or coatings applied thereto. Additionally, FIG. 1 above shows one hypothetical non-linear configuration. Other vastly different non-linear configurations may be provided. These and other changes will be apparent to the person skilled in the art after having read the subject invention disclosure.

I claim:

1. A method for manufacturing an elongate non-linear composite tube, said method comprising the steps of:

providing at least first and second elongate tube segments, said first tube segment having bend resistance different from said second tube segment;

welding said first and second tube segments in substantially end-to-end relationship to define a linear composite tube;

placing said linear composite tube in a bending apparatus;

placing a first bend of a preselected magnitude at a preselected location in a portion of said composite tube defined by said first tube segment by exerting preselected forces on regions of said tube and moving said tube at preselected speeds, said forces and said speeds for placing said first bend being selected in accordance with said bend resistance characteristics in said first tube segment; and placing a second bend of a preselected magnitude at a preselected location in a portion of said composite tube defined by said second tube segment by exerting preselected forces on regions of said tube and moving said tube at preselected speeds, said forces and said speeds for placing said second bend being selected in accordance with said bend resistance characteristics in said second tube segment and being different from said forces and said speeds for placing said first bend in said composite tube.

2. The method of claim 1, wherein the first tube segment has different cross-sectional dimensions than the second tube segment, said cross-sectional dimensions partly determining the bend resistance characteristics of each tube segment.

3. The method of claim 1, wherein said first and second tube segments each define a tube wall thickness, said thickness of said first tube segment being different than the thickness of the second tube segment, said thicknesses partly determining the bend resistance characteristics of each tube segment.

4. The method of claim 1, wherein said first tube segment is formed from a material different from said second tube segment, said materials partly determining the bend resistance characteristics of each tube segment.

5. The method of claim 1, wherein said step of welding said tube segments in end-to-end relationship comprises laser welding said tube segments.

6. The method of claim 1, wherein said step of exerting forces on said tube comprises exerting axially directed boost forces on said tube toward a location on said composite tube being bent, said boost forces being varied in accordance with the bend resistance characteristics of each tube segment.

7. The method of claim 1, wherein each said bend is placed in said composite tube at a location spaced from the welds between said tube segments.

8. The method of claim 1, further comprising the step of providing a third linear tube segment having bend resistance characteristics different from said second tube segment, securing said third tube segment to said second tube segment and placing at least one bend in said third tube segment.

9. The method of claim 1, wherein each tube segment is initially of uniform cross-sectional shape entirely along said segment, said method further comprising the step of changing the cross-sectional shape at at least one location along at least one tube segment.

10. The method of claim 9, wherein the initial cross-sectional shape of each tube segment is circular, and wherein the step of changing the cross-sectional shape comprises forming a flat on at least one tube segment.

11. The method of claim 10, wherein the step of changing the cross-sectional shape comprises hydroforming said composite tube.

12. The method of claim 11, wherein the hydroforming is carried out after the step of bending the tube.

* * * * *